United States Patent [19]

Lesner et al.

[11] 3,967,664

[45] July 6, 1976

[54] POWER DRIVEN SCREW DRIVER WITH A SCREW HOLDING NOSEPIECE

[75] Inventors: Richard S. Lesner; Murdo A. MacDonald, both of Bloomfield Hills, Mich.

[73] Assignee: Chicago Pneumatic Tool Company, New York, N.Y. ; à part interest

[22] Filed: Feb. 14, 1975

[21] Appl. No.: 550,150

[52] U.S. Cl. ..... 144/32 R

[51] Int. Cl.[2] ..... B25B 23/00

[58] Field of Search ..... 81/52.4 R; 144/32; 145/50.3, 50.5, 51, 52

[56] References Cited

UNITED STATES PATENTS

| | | | |
|---|---|---|---|
| 2,327,074 | 8/1943 | Snyder | 144/32 |
| 2,840,126 | 6/1958 | Schmitt | 145/52 |

FOREIGN PATENTS OR APPLICATIONS

| | | | |
|---|---|---|---|
| 372,622 | 11/1963 | Switzerland | 144/32 |
| 404,557 | 1/1934 | United Kingdom | 145/50 F |

*Primary Examiner*—James L. Jones, Jr.
*Attorney, Agent, or Firm*—Stephen J. Rudy

[57] ABSTRACT

A power driven screw driving tool having a screw holding nosepiece detachably mounted to its end, the nosepiece having slidable sleeve members cooperable with ball elements to obtain an initial locked condition of a screw entered into the nosepiece for positioning the screw relative to the work, and being cooperable with one another to obtain a released condition to permit the screw to be finally driven out of the tool into the work. A first embodiment describes the nosepiece as adapted for use with a tool in which the spindle and driving bit are restrained against axial movement relative to the housing. A variation of the first embodiment describes the nosepiece as having a screw back-up sleeve as being fixed to an inner sleeve, rather than relatively slidable as in the first embodiment. And a further embodiment discloses a modified form of the sleeves and back-up element in a nosepiece associated with a clutch engageable spindle and bit, the back-up element in this embodiment being adjustable according to variations in the heads of screws to be accommodated.

The arrangement of the components of the tool is such that while the tool is held in one hand, it requires a simple continuous operation of pressing a screw into the nosepiece with the other hand until a gripped condition of the screw is obtained therein.

38 Claims, 15 Drawing Figures

FIG. 5
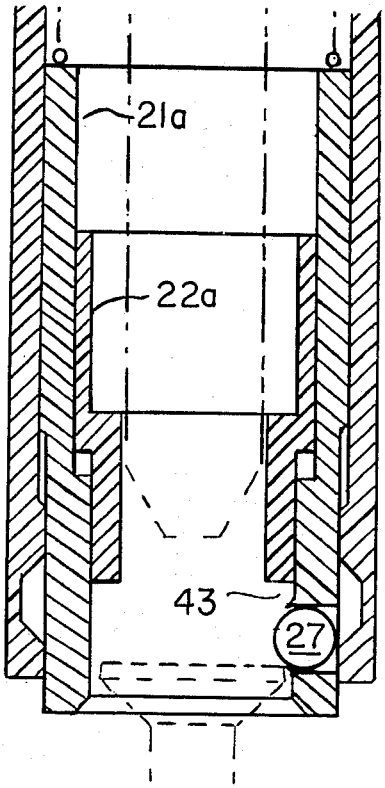
FIG. 6
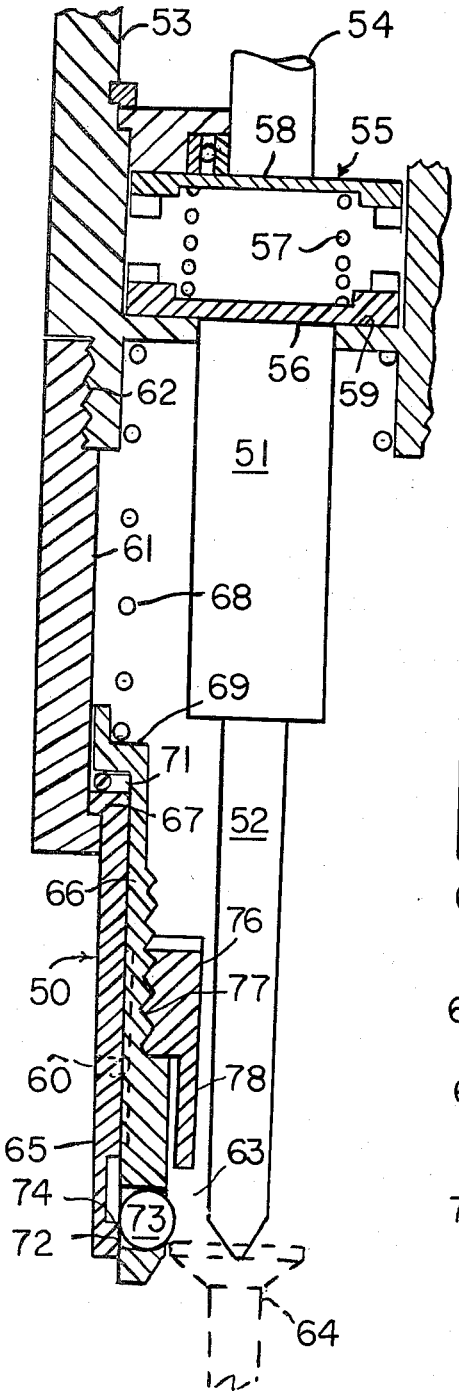
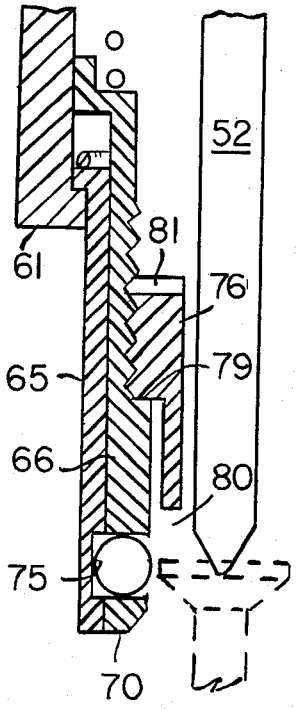
FIG. 7
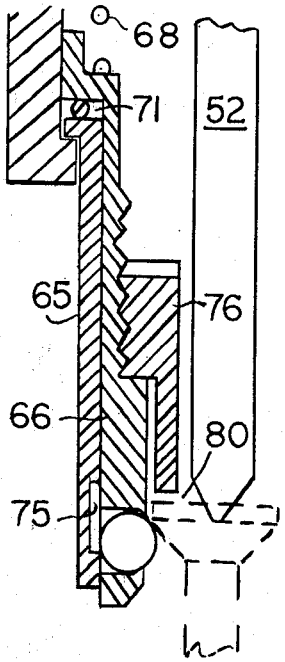
FIG. 8

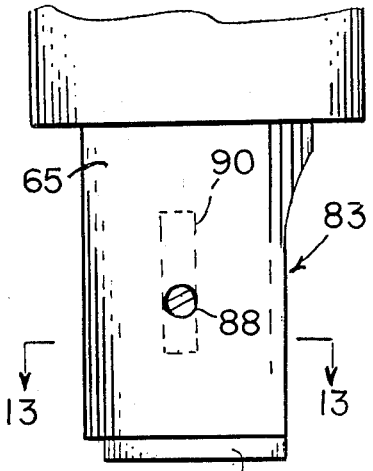
FIG. 12
FIG. 13
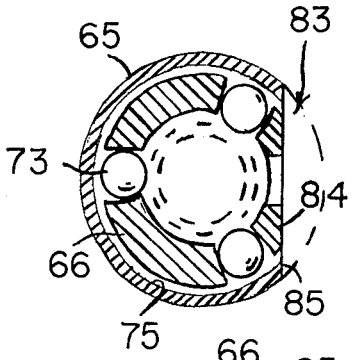
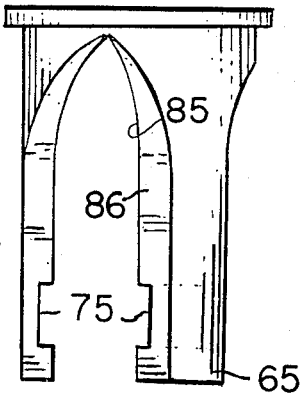
FIG. 15
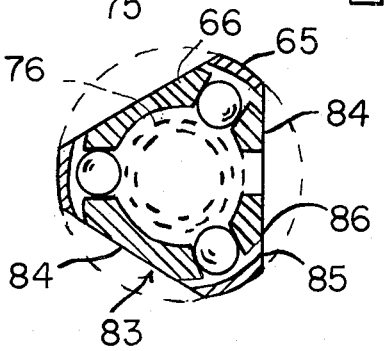
FIG. 14
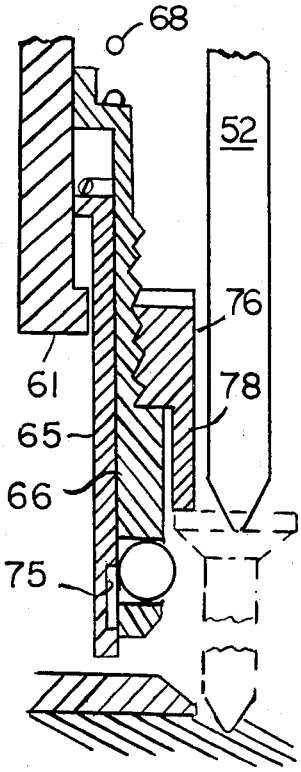
FIG. 9
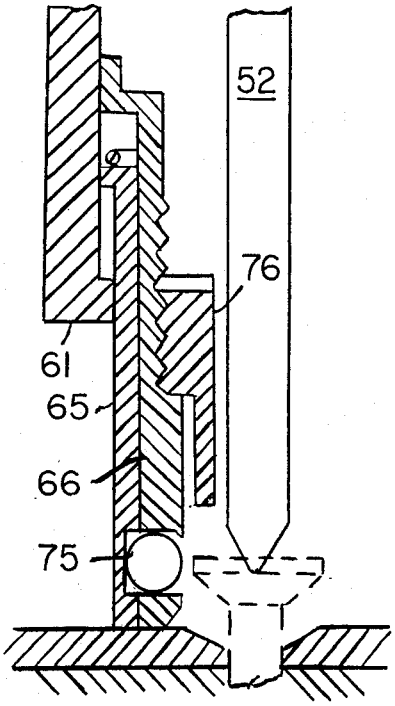
FIG. 10
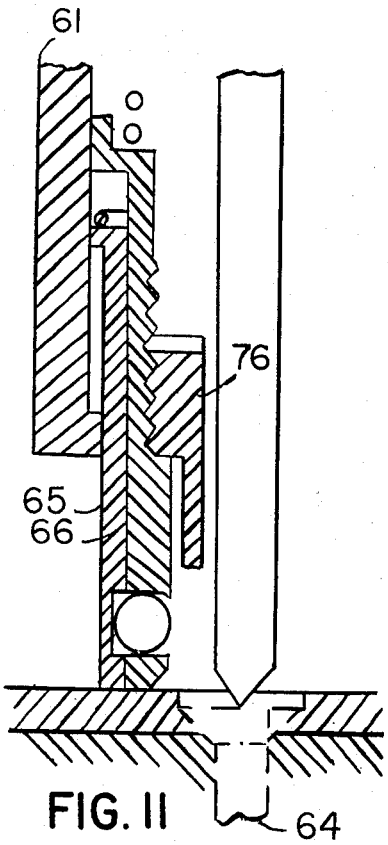
FIG. 11

POWER DRIVEN SCREW DRIVER WITH A SCREW HOLDING NOSEPIECE

BACKGROUND OF THE INVENTION

This invention relates generally to a power driven tool of the type having a nosepiece for holding an article such as a screw or nail having a head and a shank in alignment with a driver which drives the article against a workpiece. More particularly, the invention is concerned with an improved nosepiece for such tools. Selected for illustration of the invention is a hand held power screw driver.

Conventional tools of the type under consideration fall generally into two categories. In one, the screw to be driven is fed to the rear of a pair of jaws aligned with the driver and spring biased to closed condition. The point or front end of the screw is forced through the jaws until the head of the screw abuts against rear faces of the jaws. When the driver is advanced, it forces the screw forwardly causing the head to separate the jaws, thereby releasing the screw so that it can be driven against or into the work.

In this type of tool a succession of screws is usually fed to the jaws, one at a time, from a magazine or through a pneumatic tube, or the like. This type of tool is thus inherently relatively expensive and bulky and is unsuited for use in many operations where it is desired to load the screws into the tool by simply inserting them head first into the front of the nosepiece. Moreover, the jaws in the rear-loading nosepiece must be biased together with sufficient force to prevent the screw head from separating them and escaping during the jaw-loading procedure. The magnitude of this force renders it difficult and impracticable to try to load screws head first into the front end of the jaws. If the force were diminished sufficiently to facilitate easy front loading of the jaws, they would not hold a screw satisfactorily.

In the other conventional category, the screws are loaded head first into or onto the tool, but the holding device comprises simply a magnetized bit on the driving tool. The deficiencies of this arrangement are numerous and notorious: the bits are relatively expensive and must be replaced frequently since they will not hold a screw when even slightly worn; they will not hold a screw unless clear of dirt and metal particles and thus must be cleaned frequently; the bit will not hold the screw unless the screw head is rotationally aligned so that its slotting mates with the bit; the axis of the screw must be precisely aligned with that of the screw driver to avoid loosing the screw or grinding chips off of a screw head which then requires cleaning of the bit; the bit will not hold in horizontal position a relatively long shank screw having a small diameter head; in general, magnetic bits are only suitable for use with Phillips head screws and not straight slotted screws; under optimum conditions, a screw can be knocked off of the bit or cocked on the bit if even lightly brushed against or by another object.

A third conventional category of screw driver utilizes a magnetic bit in combination with a spring-type guide which engages the outer periphery of the screw head, but this arrangement is only useful where the screw is of a special type having a circumferential flat portion against which the guide engages to provide lateral support for the screw.

The object of the present invention is to provide a front loading nosepiece structure which is relatively simple and inexpensive, quick and convenient to use, and which is improved to eliminate the deficiencies of conventional front loading type screw drivers.

A feature of the nosepiece of the present invention is a ball-grip arrangement which enables a screw to be loaded into the tool through its front end in such manner that the head of the screw becomes firmly but releasably held and locked in position within the nosepiece with its shank projecting axially out of the front end of the tool.

This feature provides desirable advantages in that loading of a screw into the tool is simplified, and quickly obtained. The grip of the nosepiece upon the screw is firm so as to prevent the screw from cocking or dropping out during positioning of the screw relative to the work, or during the driving operation. The visibly projecting shank of the gripped screw enables the operator to accurately position the screw relative to the work.

Another advantageous feature of the nosepiece is a travel release structure associated with the ball-grip arrangement which cooperates with ball elements in the nosepiece during loading to obtain the positive grip of the nosepiece upon the screw, and which functions during the final stage of driving the screw to effect automatic release of the head of the screw from its gripped condition to permit it to be moved out of the nosepiece and finally seated in the work.

In accordance with the invention, there is provided a screw holding nosepiece for a screw driving tool having a screw driving bit, comprising inner and outer sleeve members having an axial slidable relation to one another, a coupling for supporting the sleeves to the housing of the tool for relative axial movement in coaxial relation to the driving bit of the tool, releasable blocking means carried by the inner sleeve normally blocking entry of the head of a screw into the inner sleeve, means carried by the outer sleeve having response to a predetermined relative retraction of the inner sleeve to effect release of the blocking means from its blocking condition so as to allow entry of the head of a screw into the inner sleeve beyond the blocking means, and spring means having response to said retracted relation of the inner sleeve to return the inner sleeve and the blocking means to their normal position so as to block the head of a screw previously entered into the inner sleeve beyond the blocking means from escaping out of the inner sleeve.

BRIEF DESCRIPTION OF THE DRAWING

In the accompanying drawing:

FIGS. 1–4 show a first embodiment of the invention in which:

FIG. 1 is a longitudinal sectional view of a hand held power driven screw driving tool having a screw holding nosepiece and showing the tool at rest in its normal position;

FIG. 2 is a detail showing the unlocked position of the nosepiece;

FIG. 3 is a detail showing the rear locked position of the nosepiece; and

FIG. 4 is a detail showing the extended locked position of the nosepiece;

FIG. 5 is a detail of a variation of the nosepiece of FIG. 1 in which the back-up sleeve is solid with the inner sleeve;

FIGS. 6–11 show a further embodiment of the invention in which:

FIG. 6 is a longitudinal sectional view of a hand held power driven screw driving tool showing a modified form of the nosepiece at rest in its normal position;

FIG. 7 is a detail showing the unlocked or released condition of the nosepiece;

FIG. 8 is a detail showing the nosepiece in gripping relation to the head of a screw entered into the nosepiece;

FIG. 9 is a detail showing the nosepiece in condition preparatory to driving the screw into the work;

FIG. 10 is a detail showing the inner and outer sleeves to have obtained a ball release condition during the progress of driving the screw, enabling the screw to move past the balls and out of the nosepiece;

FIG. 11 is a detail showing the relative positions of the nosepiece when the screw has been finally driven out of the nosepiece and seated into the work;

FIG. 12 is a detail in side elevation of the lower end of the tool, showing the nosepiece in an optional form as provided with a side flat for facilitating operation of the nosepiece in close quarters;

FIG. 13 is a cross section on line 13—13 of FIG. 12;

FIG. 14 is a view similar to that of FIG. 13, but showing the nosepiece provided with three side flats; and FIG. 15 is a detail in elevation of the outer sleeve shown in FIG. 14.

DESCRIPTION OF A PREFERRED EMBODIMENT FIGS. 1–4

Figure 1:
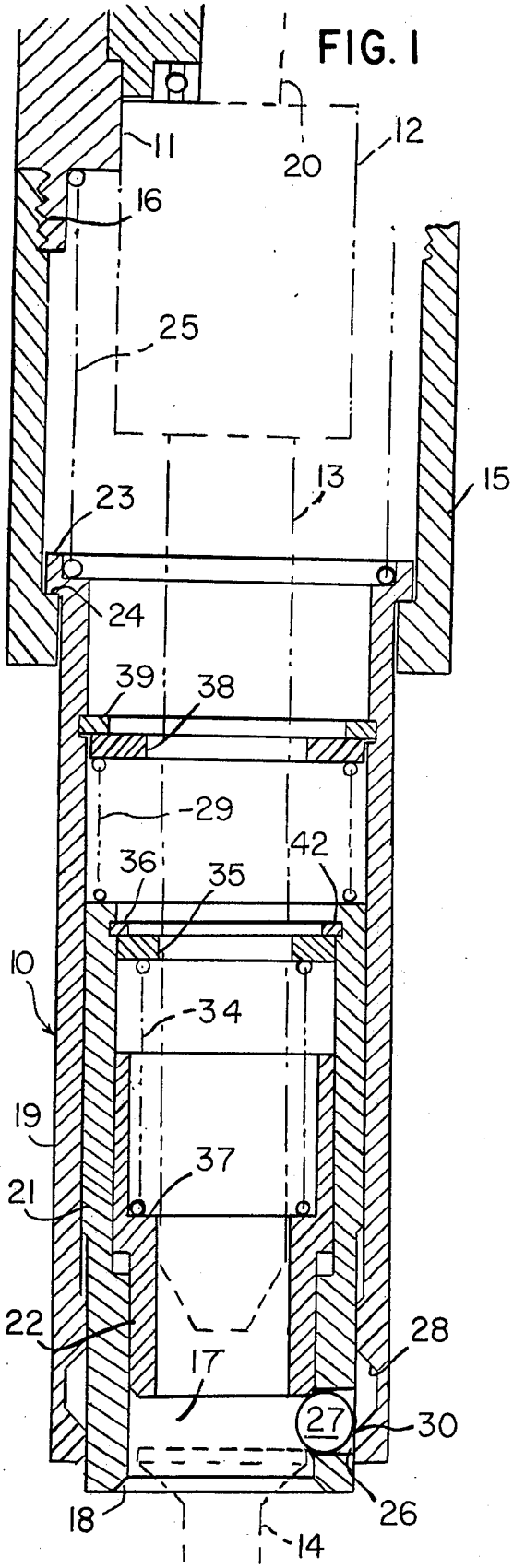

Reference is directed to the accompanying drawings, and now particularly to FIGS. 1–4, wherein the improved nosepiece is generally indicated at 10. It is illustrated here as coupled to the housing 11 of a conventional hand held power driven screw driving tool. Only so much of the tool as is needed to present the invention is shown.

The tool includes a spindle 12 to which the shank of a screw driving bit 13 is rigidly attached. The bit has a conventional driving tip engageable with the driving socket in the head of a screw 14 to be driven.

The spindle 12 has a driven connection with a motor driven shaft 20; and it is restrained against axial travel relative to the housing of the tool.

The nosepiece 10 is removably attached as a unit to the lower end of the housing of the tool in axial extension of the latter by means of a coupling member 15. The coupling is here shown as having a threaded connection at 16 with the housing. The nosepiece defines a central passage 17 into which the bit extends axially and forwardly for eventual driving engagement with the head of the screw. The latter is caused to be entered into passage 17 through a front entrance end of the nosepiece. The entrance has a coned surface 18 as a guide to facilitate entry of the screw head first.

The nosepiece includes in slidable relation to one another a cylindrical outer or ball release sleeve 19; a cylindrical inner or ball holding sleeve 21 within the outer sleeve; and a cylindrical screw back-up sleeve 22 within the inner sleeve.

The outer sleeve 19 extends slidably and axially through a bottom opening of coupling 15. A radially offset flange 23 about its upper end normally abuts upon an internal shoulder 24 of the coupling under the bias of a return spring 25.

The inner sleeve 21 has near its lower end a group of pockets or holes 26 (here three) extending radially through its side wall (only one hole being shown). The several holes lie in the same plane, and are spaced circumferentially equally apart. A ball 27 is rotatably disposed in each hole. Each ball is of greater diameter than the radial extent of the hole. An inturned lip about the inner edge of each hole prevents dropping of the ball out of the hole into passage 17. When the ball limits against the lip it protrudes into the passage, and its opposite surface protrudes slightly from the hole or sufficiently to provide a dimension over the balls that is slightly greater than the inside diameter of the outer sleeve.

The inner sleeve has limited axial slidable travel in and out of the outer sleeve, as determined by the cooperation of the balls with an annular internal groove 28 of the outer sleeve. The inner sleeve has an extended normal position under the bias of a return spring 29 (as shown in FIG. 1) in which its forward end protrudes beyond the outer sleeve; and in which position the balls are cammed by the spring load 29 on the inner sleeve as well as by the forward end of the spring loaded back-up sleeve 22 against the forward edge 30 of a forwardly inclined side or cam surface of the groove, locking the inner sleeve against further outward travel relative to the outer sleeve. In this extended locked position of the inner sleeve, the protrusion of the balls into the nosepiece passage 17 defines a throat or restriction which blocks, while the balls remain in this condition, entry of the head of the screw 14 into the nosepiece passage beyond the balls, the head of the screw being of greater diameter than the restricted throat defined by the protruding balls.

Figure 2:
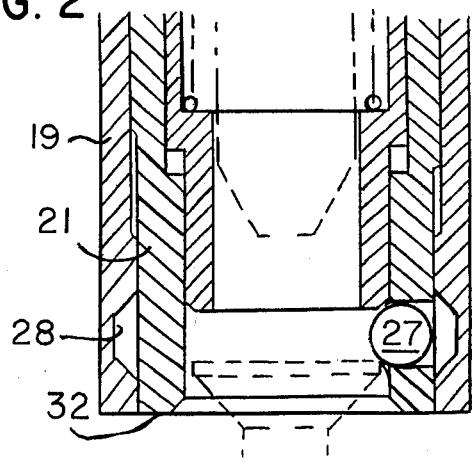

The inner sleeve 21 has an intermediate unlocked position, as indicated in the detail of FIG. 2, in which its forward normally projecting end 32 is flush with the corresponding end of the outer sleeve 19; and in which position the balls 27 are registered with groove 28 so as to be free to move outwardly from the holes of the inner sleeve to protrude into the groove sufficiently to unblock the nosepiece passage 17 for free movement therein of the head of a screw in either direction past the balls. As the screw is moved inwardly or outwardly in the unlocked position of the sleeve, the head of the screw cams the balls into groove 28.

Figure 3:
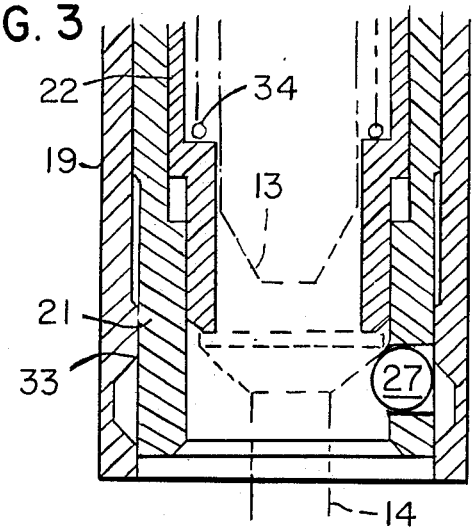

The inner sleeve has a retracted locked position, as indicated in the detail of FIG. 3, in which it is retracted against the bias of its return spring into the outer sleeve 19; and in which position the balls are cammed against the rear edge 33 of a rearwardly inclined side or cam surface of the groove limiting the sleeve against further retracted movement. In the movement of the sleeve to this position, the balls obtain a position at the underside of the head of a screw 14 that had previously been moved from the FIG. 2 position into the nosepiece beyond the balls.

The back-up sleeve 22 is biased by a return spring 34 forwardly relative to the inner sleeve to abut in a normal position against the several balls. The back-up sleeve under the load of its spring is cooperable with the inner sleeve and balls in obtaining a releasable positive gripped condition on the head of a screw entered into the nosepiece beyond the balls, as appears in FIG. 4.

The back-up sleeve spring 34 is preloaded between a washer 35 retained in the back-up sleeve by a retaining ring 36 and an internal shoulder 37. The inner sleeve spring 29 is preloaded between a washer 38 retained in the outer sleeve by a retaining ring 39 and an end shoulder 42. Rings 36 and 39 are contained in annular grooves respectively in inner sleeve 21 and outer sleeve 19 as shown. The respective rates and preloading of springs 25, 29 and 34 are correlated to respond to compressive forces in such a way as to facilitate movements of sleeves 19, 21 and 22 relative to each other and relative to adapter 15 in the manner described below. For convenience, spring 25 may be regarded as stronger than spring 34, and spring 34 may be regarded as stronger than spring 29. However, these specific relationships may not obtain outside of the ranges of movement of the various elements in which they perform their respective functions.

The screw driving bit 13 extends axially through the outer and inner sleeves into the back-up sleeve.

In summary of the operation of the nosepiece as coupled to the tool: a screw 14 is inserted head first into the inner sleeve 21 through the front end of the nosepiece. When the head of the screw contacts the inwardly protruding balls 27 (FIG. 1), further inward travel of the screw against the balls forces both the inner sleeve and the back-up sleeve inward against their springs 29 and 34 relative to the outer sleeve 19. As the balls are moved in this action away from the forward edge 30 of groove 28, the head of the screw acts as a cam to force the balls outwardly from the nosepiece passage into the groove. As the inner sleeve reaches the unlocked position (FIG. 2), the balls will be fully registered with the groove and will have been cammed by the screw head out of the nosepiece passage into the groove sufficiently to allow the head of the screw to pass beyond the balls into contact with the back-up sleeve 22.

Further inward travel of the screw after passing the balls will then act upon the back-up sleeve 22 to carry by means of its spring 34 the inner sleeve 21 further inward relative to the outer sleeve 19. As the inner sleeve is then carried rearwardly, the balls are cammed by the rear inclined surface of the groove outwardly of the groove against the underside of the head of the screw and against the rear edge 33 of the groove, thus locking the sleeve from moving rearwardly of its retracted position and simultaneously clamping the head of the screw between the back-up sleeve and the balls, as indicated in FIG. 3.

Figure 4:
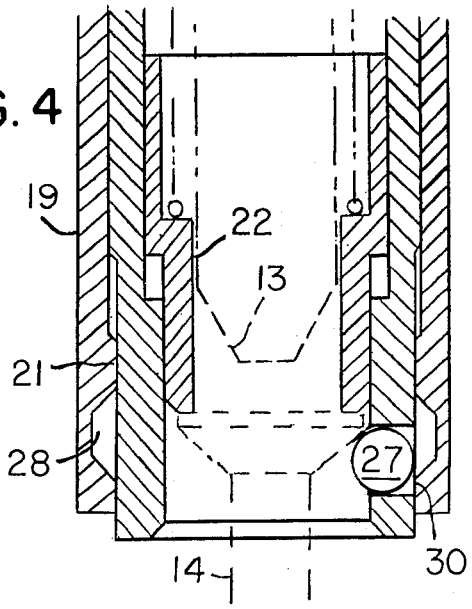

As the operator next releases the inward pressure of his hand from the screw, the inner sleeve spring 29 relaxes to return the inner sleeve to its extended lock position, as in FIG. 4. The spring loaded back-up sleeve 22 follows the head of the screw in this movement. In this transition of the inner sleeve and back-up sleeve from their rear lock position of FIG. 3 to their extended lock position of FIG. 4, the movement of the sleeves past the unlock position of FIG. 2 is done without loss of control over the screw. This is because of the rapidity of the transition over the short axial span of groove 28.

With the inner sleeve in its extended lock position and the screw now positively gripped between the back-up sleeve and the balls (as in FIG. 4) the tool may, without losing control of the screw, be maneuvered about by the operator in any direction to locate the visibly extending shank of the screw precisely on the work. The back-up sleeve 22 provides a uniform backing support to the screw at this time which steadies the screw as it is being located relative to the work.

To now drive the screw into the work, the operator presses lightly forward upon the tool while the screw is engaged with the work. Back-up sleeve 22 is restrained from movement toward the work by engagement with the screw head. Outer sleeve 19 advances toward the work under the superior force of spring 25, but inner sleeve 21 is restrained from advancing with the outer sleeve by the intermediate force of spring 34, weaker spring 29 compressing to facilitate this relative movement of the inner and outer sleeves. During this relative movement, the parts shift from the extended lock position of FIG. 4 past the unlock position of FIG. 2 and to the retracted lock position of FIG. 3. As in the loading procedure, this transition between the two lock positions occurs so rapidly that control of the screw is not lost. During this movement, bit 13 is advanced into engagement with the screw head. The operator then activates the motor to cause the driving bit to drive the screw into the work.

Thereafter, sleeves 19, 21 and 22 follow movement of the screw head until outer sleeve 19 contacts the work, and its movement is arrested. Inner sleeve 21 continues to advance until it too contacts the work and is arrested. Sleeves 19 and 21 are now in the unlock position of FIG. 2. Then spring 25 begins to compress, and the housing of the tool slides forwardly relative to the outer sleeve causing the bit to continue driving the screw forwardly. The head of the moving screw cams the balls outwardly of its path, and the screw can now be driven fully to seated condition in the work. Back-up sleeve 22 steadies the screw during all but the latter stages of the screwdriving procedure.

When the tool is lifted from the work, the elements of the nosepiece restore to normal condition.

An advantage provided by the spring 34 loading the back-up sleeve 22 is that it is yieldable to accommodate in gripping relation between itself and the balls screw heads of various thicknesses. This advantage is not obtained where, as indicated in the variation of FIG. 5, the back-up sleeve 22*a* is solid with or has a fixed position with the inner sleeve 21*a*. In the latter arrangement, the back-up sleeve 22*a* is limited in the thickness of screw heads that may be accommodated in the space 43 between it and the balls 27. However, sleeve 22*a* can be press fitted into sleeve 21*a* and can be press moved in either direction as desired to adjust its position for accommodating screw heads of different thicknesses.

While the nosepiece disclosed in FIGS. 1–5 is illustrated in association with a tool having a spindle restrained against axial movement relative to the housing it may also be operatively associated with a tool wherein the spindle carrying the driving bit is axially slidable relative to the housing for disengagement with an axially disengageable driving clutch.

FURTHER EMBODIMENT OF THE INVENTION

FIGS. 6–11

The embodiment of the invention illustrated in FIGS. 6–11 discloses a variation of the nosepiece from that shown in FIGS. 1–5. In this further embodiment, the nosepiece 50 is associated with a conventional hand held power driven screw driving tool in which a spindle 51 carrying a screwdriving bit 52 is axially slidable relative to the housing 53 of the tool; and is associated with the drive shaft 54 of a rotary motor by means of an axially disengageable clutch 55.

The spindle carries at its rear a face-jaw driven clutch member 56 which is engageable against the bias of a clutch spring 57 with an opposed face-jaw driving clutch member 58. The latter is connected with the drive shaft 54 of the motor and is restrained against axial movement relative to the housing.

The spindle has a normal position as in FIG. 6, wherein a shoulder of the spindle rests upon a shoulder 59 of the housing under the bias of the clutch spring, the latter normally holding the driven clutch member disengaged from the driving clutch member. The spindle is retractable relative to the housing and the clutch spring to engage the clutch members.

The nosepiece 50 is removably attached as a unit to the bottom of housing 53 in axial extension of the latter by means of a coupling 61. The latter has a threaded connection at 62 with the housing. The nosepiece defines a central passage 63 into which a headed screw 64, intended to be driven, may be entered for engagement with the bit. The entrance to the nosepiece has a coned surface as a guide to facilitate entry of the screw head first. The tip of the bit extends into the entrance where it may be visibly engaged with the head of the screw.

The nosepiece includes, in slidable relation to one another and to the housing and coupling 53, 61, a cylindrical outer or ball release sleeve member 65, and a cylindrical inner or ball holder sleeve member 66.

The outer sleeve 65 extends slidably and axially through an open bottom end of the coupling; and is limited in its extended position by the abutment of a flange 67 about its upper end upon an internal shoulder of coupling 61.

The inner sleeve 66 extends slidably through the outer sleeve. It has a normal position under the bias of a return spring 68 in which a flange 69 about its upper end abuts upon and exerts a compressive force upon a resilient O-ring 71 seated atop the flange of the outer sleeve. In the normal or extended position of the inner sleeve, its nose end 70 protrudes out of and beyond the bottom of the outer sleeve (as shown in FIG. 6).

The inner sleeve has near its lower end a group of ball pockets or holes 72 (here three) extending radially through its side wall. The several holes lie in the same plane; and are spaced circumferentially equally apart. A ball 73 is rotatably disposed in each hole. Each ball is of greater diameter than the radial extent of the hole.

An inturned lip about the inner edge of each hole prevents dropping of the ball out of the hole into passage 63. When the ball limits against the lip it protrudes into the passage, and its opposite surface protrudes slightly from the hole sufficiently to provide a dimension over the balls that is slightly greater than the inside diameter of the outer sleeve.

The inner sleeve has limited axial travel relative to the outer sleeve, as determined by the cooperation of the balls with an internal annular groove 75 in the outer sleeve. In the extended normal position of the inner sleeve (as in FIG. 6) its forward end 70 protrudes beyond the outer sleeve and the balls 73 are locked against or limit upon the lower annular edge 74 of the groove. In this extended position of the inner sleeve, the balls protrude into the central passage 63 to define a releasable throat or restriction of lesser diameter than the head of the screw 64 so as to normally block movement of the screw into the central passage beyond the balls.

The inner sleeve has a retracted second position (as in FIG. 7) in which its normally protruding nose end 70 is flush with that of the outer sleeve, and in which the several balls are registered with and movable into the groove 75 of the outer sleeve upon inward movement of the head of the screw. The groove is deep enough in its radial dimension to allow the balls to be moved out of the central passage sufficiently to allow the head of the screw to pass in either direction beyond the balls.

A back-up ring nut 76 is disposed in the nosepiece passage in coaxial surrounding relation to the driving bit 52 and with clearance from the latter. It has a threaded rear portion engaged at 77 with an internal threaded portion of the inner sleeve. It has a forwardly extending skirt 78 against the forward end of which the head of a screw passed sufficiently beyond the balls is adapted to abut, as indicated in FIG. 9. The back-up nut 76 serves to provide a uniform backing support to the head of the screw as it is being initially driven by the bit.

The back-up nut 76 has a forwardly limited position upon a shoulder 79 of the inner sleeve to provide a predetermined clearance 80 between the forward end of the nut and the balls. This allows reception with some tolerance between the nut 76 and the balls of a screw head of a predetermined thickness after the head has been moved beyond the balls, as indicated in FIG. 8. The threaded connection 77 of the nut 76 with the inner sleeve permits relative adjustment of the nut to accommodate between it and the balls screw heads of various thicknesses.

Drive slots 81 are provided in the head of the nut for application of a proper tool in making adjustments of the nut. The adjustment is made before coupling the nosepiece to the tool.

In the normal position of the nosepiece and the spindle, the driving bit extends forwardly beyond the balls to a point short of the forward end of the inner sleeve where it is visible for seating engagement with the head of the screw, as in FIG. 6.

In summary of the operation of the nosepiece in association with the tool: as a screw 64 (FIG. 6) is manually inserted head first into the inner sleeve 66 through the front end of the nosepiece, its head is seated over the tip of the driving bit 52 and contacts the undersurfaces of the protruding balls 73. Further inward travel of the screw (FIG. 7) simultaneously slides the bit and spindle rearwardly against the clutch spring, and acts through the balls to slide the inner sleeve 66 against its spring relative to the coupling 61 and the outer sleeve 65. In this action, the inner sleeve is unseated from its pressed relation to the resilient rubber O-ring. The latter in relaxing exerts a forward force upon the outer sleeve serving to avoid movement of the latter rearwardly together with the inner sleeve. Normally, the relative looseness of the outer sleeve relative to the inner sleeve avoids such movement. However, the O-ring action serves to ensure against such movement. Optionally, a screw 60 (broken line, FIG. 6) may be provided in the outer sleeve having cooperation with a vertical guide slot in the surface of the inner sleeve to prevent angular movement of the sleeves relative to one another while at the same time permitting relative axial movement of the sleeves. As the balls become registered in this rearward movement of the inner sleeve with groove 75, the head of the rearwardly moving screw cams the balls aside into the groove and passes the balls.

After the screw head is moved beyond the balls into the clearance 80 between the back-up nut and the balls and then manually released by the operator, the relaxing force of spring 68 upon the inner sleeve 66 dislodges the balls from the shallow groove 75 and abruptly returns the inner sleeve to obtain the position in FIG. 8 corresponding to its normal extended position. Upon return of the inner sleeve to its extended position the balls again protrude into the nosepiece central passage, but now at the underside of the head of the screw. Also, as a consequence of the manual release of the screw, the driving bit 52 moves forwardly under the bias of the clutch spring to press and clamp the head of the screw firmly against the balls, as also shown in FIG. 8.

With the screw now firmly gripped and locked in the FIG. 8 position in the nosepiece, and with the working end of the screw visibly projecting out of the nosepiece, the operator may, without fear of losing the screw, maneuver the tool about in any direction needed to precisely locate the screw relative to the work.

To drive the screw into the work against which it is now positioned, the operator presses forwardly on the tool causing the housing and coupling 53, 61 to move forwardly relative to the spindle and bit to engage the driving clutch member 58 with the driven clutch member 56 against the bias of the clutch spring. In this action (as appears in FIG. 9) spring 68 forces the inner sleeve forwardly until the back-up nut 76 limits against the head of the screw. The balls are carried in this action a corresponding distance clear of the underside of the head of the screw; and the loosely disposed outer sleeve slides downwardly relative to the inner sleeve until the upper annular edge of its groove 75 limits or locks upon the several balls. The outer sleeve in obtaining the FIG. 9 position protrudes at its nose end slightly forwardly of the inner sleeve. Here again the transition between the locked positions of FIGS. 8 and 9 occurs so quickly that control of the screw is not lost in passing the unlocked position of FIG. 7.

While continuing to exert a forward thrust upon the tool the operator activates the motor, causing the driving bit to drive the screw into the work.

The back-up nut serves to stabilize the screw during the initial stage of driving it into the work. As the screw progressively enters the work, the back-up nut follows it in pressing contact with its head. Eventually, as the tool is moving forwardly with the screw, the outer sleeve contacts the work surface and is forced upwardly to register its groove 75 with the balls, at which time the bottom ends of both sleeves will be flush with each other. Next, as the screw continues entering the work, both sleeves are retracted upwardly relative to the downwardly moving screw. In this action, the balls are cammed by the screw out of its path into the groove (as in FIG. 10). The screw is then driven past the balls out of the nosepiece and finally seated in the work (as appears in FIG. 11).

As the tool is next lifted from the work, the components of the tool and nosepiece restore to normal.

FIGS. 12–15

The tool may optionally be formed with a side flat, generally referenced 83 in FIG. 12, formed in the walls of the inner and outer sleeves as indicated in FIGS. 12 and 13. This flat is of advantage in that it facilitates positioning of the nosepiece for operation in close quarters. Additional flats 83, if desired, may be added (for example, as in FIG. 14) wherein three side flats are shown. Each side flat is defined by a flat 84 on the surface of the inner sleeve which extends upwardly for a selected distance from the forward end of the inner sleeve and is exposed through a complementary opening 85 made through the outer sleeve. The wall area 86 about the opening is co-planar with the flat 84 formed on the inner sleeve.

In the FIGS. 12–15 structures if sleeves 65 and 66 were permitted to rotate relative to each other, balls 73 could fall out of the ends of the groove or groove segments 75 created by the flat or flats. Suitable means are provided to prevent such relative rotation; and as illustrated in FIG. 12, may comprise simply a screw 88 threaded through a wall portion of outer sleeve 65 and engaged in a vertical guide slot 90 in inner sleeve 66.

It will be observed that in the FIGS. 14–15 structure, the cut-away portions of the sleeves form what may be regarded as a plurality of pairs of fingers, which are longitudinally slidable relative to each other to effect the locking and unlocking movements of balls 73. It is within the ambit of the invention to mount such pairs of fingers on the tool housing by means other than by connection to a pair of concentric sleeves.

In the various forms of the invention illustrated, balls 27 and 75 are shown as being distributed circumferentially equally apart. However, it will be understood from a contemplation of FIGS. 13 and 14 that the balls could have other circumferential distribution to accommodate various arrangements of flats 83. For one example, four balls could be used arranged in two diametrically opposite pairs, with the balls of each pair being relatively closer together than the circumferential distance between the pairs. Such an arrangement would facilitate the provision of two parallel oppositely disposed flats 83.

While the invention has been disclosed with reference to a screw driver, it is applicable, in general, to tools for driving any type of article having a head and a shank such as nails, rivets, bolts or headed studs. In addition to a rotating driver as disclosed herein, the invention is also applicable to tools utilizing percussive or reciprocating drivers as in nailers or riveters, or steady linear pressure drivers such as might be actuated by a hydraulic cylinder.

We claim:

1. A screw holding nosepiece for a screw driving tool having a screw driving bit, comprising inner and outer sleeve members having an axial slidable relation to one another, the inner sleeve having a normal position projecting axially out of a front end of the outer sleeve under the bias of a spring load, a coupling for supporting the sleeves to the housing of the tool for relative axial movement in coaxial relation to the driving bit of the tool, releasable blocking means carried by the inner sleeve normally blocking entry of the head of a screw into the inner sleeve, said inner sleeve being retractible into said outer sleeve against the bias of the spring load in response to axial force against said blocking means of a screw head seeking entry into said inner sleeve, means carried by the outer sleeve having response to a predetermined extent of said relative retraction of the inner sleeve to effect release of the blocking means from its blocking condition so as to allow entry of the head of a screw into the inner sleeve beyond the blocking means, and the spring load having response to said predetermined retracted relation of the inner sleeve to return the inner sleeve and the blocking means to their normal position so as to block the head of a screw previously entered into the inner sleeve beyond the blocking means from escaping in the opposite direction out of the inner sleeve.

2. A screw holding nosepiece, adapted to be coupled to the housing of a screw driving tool in axial extension of the housing, comprising inner and outer sleeves having an axially slidable relation to each other, a coupling supporting the outer sleeve for relative sliding movement and adapted at its rear end for attachment to a forward end of the housing of the screw driving tool, the coupling having a forward open end through which the outer sleeve projects, a first spring biasing the outer sleeve to a predetermined position in its projecting relation to the coupling, a second spring biasing the inner sleeve outwardly of a forward end of the outer sleeve, an annular internal groove in the outer sleeve proximate the forward end of the latter having forward and rear annular parallel edges, ball elements carried by the inner sleeve proximate its forward end, the ball elements normally abutting the forward edge of the groove limiting the extent of outward movement of the inner sleeve relative to the outer sleeve under the bias of the second spring, the ball elements being cooperable with the rear edge of the groove to limit the extent of rearward movement of the inner sleeve relative to the outer sleeve upon an inward force being applied to the inner sleeve overcoming the bias of the second spring, the ball elements having when abutting the forward edge or when cooperating with the rear edge of the groove a position protruding radially in a common plane into a central passage of the inner sleeve to block axial movement of the head of a screw beyond the ball elements in either direction in the passage, and the ball elements having an intermediate position seated partly in the groove in a non-protruding relation to the passage so as to allow axial movement of the head of a screw beyond the ball elements in either direction in the passage upon an inward force being applied to the inner sleeve overcoming the bias of the second spring and moving the inner sleeve to said intermediate position.

3. A nosepiece as in claim 2, including a back-up sleeve slidably disposed within the inner sleeve, and a third spring exerting a forwardly biasing force upon the back-up sleeve relative to the inner sleeve, the back-up sleeve having a normal position under the bias of the third spring in which a forward end of the back-up sleeve abuts the protruding ball elements in the normal position of the inner sleeve.

4. A nosepiece as in claim 3, wherein the forward end of the back-up sleeve is subject to abutment with the head of a screw entered into the passage beyond the ball elements.

5. A nosepiece as in claim 3, wherein the first spring is adapted to be seated between a shoulder of the outer sleeve and an internal shoulder of the housing of the tool.

6. A nosepiece as in claim 5, wherein the second spring is seated between a shoulder of the inner sleeve and an internal abutment carried by the outer sleeve.

7. A nosepiece as in claim 6, wherein the first spring is preloaded to a value higher than that of the second spring.

8. A nosepiece as in claim 4, wherein the third spring is seated between a shoulder of the back-up sleeve and an internal abutment of the inner sleeve.

9. A nosepiece as in claim 8, wherein the first spring is preloaded to a value higher than that of the second spring, and the second spring is preloaded to a value less than that of the third spring.

10. A nosepiece as in claim 2, including a back-up sleeve disposed within the inner sleeve in fixed relation to the latter in a predetermined spaced relation rearwardly of the ball elements, the spaced relation being sufficient to accommodate a head of predetermined size of a screw entered into the passage beyond the ball elements.

11. A hand held power driven screw driving tool comprising a motor powered spindle carrying a screw driving bit, a housing supporting the spindle for relative rotation, the spindle and driving bit being restrained against axial movement relative to the housing, a nosepiece for holding a screw to be drivingly engaged by the bit, and a coupling for detachably coupling the nosepiece to the housing in axial extension of the latter, wherein the nosepiece comprises inner and outer sleeves having an axially slidable relation to one another, the outer sleeve having an axially slidable relation to the coupling and projecting through an open forward end of the coupling, a first spring biasing the outer sleeve in its projecting relation, an abutment on the coupling having cooperation with an abutment on the outer sleeve determining the extent of said projection, a second spring biasing the inner sleeve axially outwardly of the outer sleeve, an annular internal groove in the outer sleeve having forward and rear annular opposed edges, ball elements carried by the inner sleeve, the ball elements normally abutting the forward edge of the groove limiting the extent of outward movement of the inner sleeve relative to the outer sleeve under the bias of the second spring, the ball elements being cooperable with the rear edge of the groove to limit the extent of rearward movement of the inner sleeve relative to the outer sleeve upon the inner sleeve being pressed inwardly of the outer sleeve against the bias of the second spring, the ball elements having when abutting either the forward or rear edge of the groove a position protruding from the inner sleeve radially into a central passage of the inner sleeve so as to block movement of the head of a screw beyond the ball elements in either axial direction in the passage, and the ball elements having an intermediate position seated partly in the groove in a non-protruding relation to the passage so as to allow axial movement of the head of a screw beyond the ball elements in either direction upon the inner sleeve being pressed inwardly of the outer sleeve against the bias of the second spring a predetermined distance.

12. A hand held power driven screw driving tool as in claim 11, wherein the groove is shallow relative to the diameter of the ball elements so that the ball elements are dislodgeable from the groove to the position abutting the forward edge of the groove by the bias of the second spring following release of inwardly directed pressure from the inner sleeve, and the inner sleeve is returnable upon such release by the second spring to its normal position.

13. A hand held power driven screw driving tool as in claim 12, including a back-up sleeve slidably disposed within the inner sleeve, a third spring exerting a forwardly biasing force on the back-up sleeve, the back-up sleeve having a normal position under the bias of the third spring in which a forward end of the back-up sleeve abuts the protruding ball elements in the normal position of the inner sleeve.

14. A hand held power driven screw driving tool as in claim 13, wherein the forward end of the back-up sleeve is subject to abutment with the head of a screw entered into the passage beyond the ball elements.

15. A hand held power driven screw driving tool as in claim 14, wherein the first spring is preloaded to a value higher than that of the second spring, and the second spring is preloaded to a value less than that of the third spring.

16. A screw holding nosepiece detachably mountable to the housing of a screw driving tool, comprising inner and outer relatively slidable sleeves, a coupling adapted to be detachably mounted to the housing of a screw driving tool having an open bottom end through which the inner and outer sleeves project, means supporting the outer sleeve to the coupling for relative axial sliding movement, spring means biasing the inner sleeve outwardly of the forward end of the outer sleeve, means on the inner sleeve having cooperation with abutment means on the outer sleeve for limiting the outward relative movement of the inner sleeve to a predetermined extended normal position, ball elements carried by the inner sleeve having in the normal position of the inner sleeve a radial position protruding into the interior of the inner sleeve blocking entry of the head of a work screw rearwardly into the inner sleeve beyond the ball elements, means on the outer sleeve having cooperation with the ball elements in an inwardly pressured predetermined retracted position of the inner sleeve relative to the outer sleeve to release the ball elements from their protruding condition so as to allow entry of a work screw into the inner sleeve beyond the ball elements, and the inner sleeve having cooperation under the bias of its spring with the said means on the outer sleeve to restore the ball elements to their protruding position following relaxing of the inwardly pressured condition of the inner sleeve.

17. A screw holding nosepiece adapted to be coupled to the housing of a screw driving tool in axial extension of the housing, comprising inner and outer sleeves disposed in axial slidable relation to each other, a coupling supporting the outer sleeve for relative axial sliding movement adapted at its rear for attachment to a forward end of the housing of the tool in axial extension of the housing, the coupling having a forward open end through which the outer sleeve projects and having an internal abutment upon which an abutment of the outer sleeve normally limits, the inner sleeve having a normal position in which a forward end thereof projects a predetermined distance beyond the outer sleeve and a shoulder at its other end disposed within the coupling abuts upon the abutment of the outer sleeve, a spring means within the coupling for biasing the inner and outer sleeves to their normal positions, an annular internal groove in the outer sleeve near its forward end, balls carried by the inner sleeve near its forward end having a normal position protruding in part from the inner sleeve into the interior of the inner sleeve, an annular forward edge of the groove defining a backing surface normally backing the balls into the said protruding position, means on the inner sleeve preventing the balls from dropping into the interior of the inner sleeve free of the latter, the balls defining in their protruding position a restriction blocking axial entry of the head of a screw into the interior of the inner sleeve beyond the balls, the inner sleeve having a predetermined retracted position against the bias of the spring means relative to the outer sleeve in which the balls register with the groove and are subject to being moved partly out of the inner sleeve into the groove sufficiently to allow the head of a screw to be entered axially into the interior of the inner sleeve beyond the balls, and the balls together with the inner sleeve being restorable to their normal position from the retracted position of the inner sleeve upon relaxing of the spring means.

18. A nosepiece as in claim 17, including a back-up ring nut threadedly engaged to an inner wall area of the inner sleeve in a predetermined rearwardly spaced relation to the balls, a forward end of the ring nut presenting a stop to the head of a screw entered into the interior of the inner sleeve beyond the balls.

19. A nosepiece as in claim 18, wherein the ring nut is adjustable axially relative to the inner sleeve so as to vary the spacing between the ring nut and the balls.

20. A nosepiece as in claim 17, wherein an annular spring element disposed between the shoulder of the inner sleeve and the abutment of the outer sleeve is under compression exerted by the spring means through the inner sleeve.

21. A nosepiece as in claim 17, wherein a flat is defined in a side area of the nosepiece extending from its forward end rearwardly for a selected distance.

22. A nosepiece as in claim 21, wherein the flat is comprised of a flat in a side wall of the inner sleeve exposed through a cutaway opening in the outer sleeve.

23. A nosepiece as in claim 17, wherein means in the outer sleeve is cooperable with means in the inner sleeve for restraining angular movement of the inner and outer sleeves relative to each other without restraining axial movement of the inner sleeve relative to the outer sleeve.

24. A nosepiece for a screwdriving tool for gripping the screw for engagement by the driving bit of the tool and for guiding the screw out of the tool under the driving action of the bit into the work, including a coupling for detachably supporting the nosepiece to the housing of the tool in axial alignment with the driving bit, an outer sleeve supported by the coupling for relative axial movement, an inner sleeve axially slidable within the outer sleeve and projecting out of a front end of the outer sleeve, the inner sleeve having a rear shoulder normally abutting upon a rear shoulder of the outer sleeve under the bias of a spring load, ball elements carried in radial holes of the inner sleeve normally protruding in a common plane into the interior of the inner sleeve in surrounding relation to the driving bit of the tool and normally blocking axial passage of the head of a screw in the inner sleeve beyond the ball elements in either direction, an internal annular groove in the outer sleeve normally positioned axially of said ball elements toward said coupling so as to be out of register with the ball elements, the inner sleeve being axially retractible into the outer sleeve to bring the ball elements into register with the groove, and the groove being of sufficient radial depth to partially receive the registered ball elements so as to unblock the interior of the inner sleeve to allow axial movement of the head of a screw within the inner sleeve beyond the ball elements.

25. For a tool having a housing which supports a driver for driving an article of the type having a head and a shank toward a work piece, an article holding nosepiece which comprises, a plurality of members, coupling means adapted to mount said members on the tool housing in an array around the driver, said members being relatively movable generally parallel to the direction in which said driver advances an article with respect to a work piece, blocking means carried by said members, said members having first and second relative positions in which said blocking means is respectively in locked and unlocked condition relative to said members, means providing a bias yieldably urging said members toward said first position, said blocking means in locked condition forming an obstruction to free passage of an article head generally counter to said direction from without said array toward a location within said array, said blocking means and members being movable against said bias to said second position responsive to movement in said counter direction of an article head against said obstruction, said blocking means in said unlocked condition being movable under the impetus of an article head so moving to remove said obstruction thereto, said members being returnable to said first position under said bias responsive to passage of an article head so moving beyond said blocking means for reestablishing said obstruction, said obstruction being positioned to engage an article head so passed to form in part a support for holding the article in alignment with the driver and with the article shank projecting generally in said direction, said coupling means so supporting said members that said members and blocking means are movable as a unit in said direction responsive to an initial movement of the driver in said direction, and means associated with the assembly of said members and blocking means operable to effect movement of said members to said second position responsive to a further movement of the driver in said direction.

26. The structure defined in claim 25, wherein said members comprise a plurality of pairs of fingers extending generally parallel to said direction, the fingers of each pair being so relatively movable.

27. The structure defined in claim 26, wherein said blocking means comprises a plurality of blocking elements each carried by a said pair of said fingers.

28. The structure defined in claim 27, wherein each blocking element comprises a ball carried by the inner fingers of each pair and being so movable outwardly into a groove in the outer finger of the pair.

29. The structure defined in claim 28, wherein the inner and outer fingers of each pair comprise extensions respectively of inner and outer concentric sleeves, and means constraining said sleeves against relative rotation to maintain rotational alignment of said fingers.

30. The structure defined in claim 25, wherein said members comprise a pair of sleeves generally concentric around the axis of the driver.

31. The structure defined in claim 30, wherein said means associated with the assembly of said members and blocking means comprises an end portion of one of said sleeves projecting axially beyond the end of the other sleeve in said direction.

32. The structure defined in claim 31, wherein said one sleeve comprises said inner sleeve.

33. The structure defined in claim 31, wherein said one sleeve comprises said outer sleeve.

34. In combination, an article driving tool and a nosepiece of the type defined in claim 25 mounted thereon.

35. In combination, an article driving tool and a nosepiece of the type defined in claim 26 mounted thereon.

36. In combination, an article driving tool and a nosepiece of the type defined in claim 31 mounted thereon.

37. A screw holding nosepiece for a screwdriving tool having a screwdriving bit, comprising inner and outer sleeves having an axial slidable relation to one another, a coupling for supporting the sleeves to the housing of the tool for relative axial movement in generally coaxial relation to the driving bit of the tool, said outer sleeve having an end which faces away from said coupling, releasable blocking means carried by the inner sleeve, release means carried by the outer sleeve, said inner sleeve being biased by a spring load toward an advanced position relative to said outer sleeve wherein said blocking means is disposed axially between said release means and said end of said outer sleeve, said blocking means in said advanced position of said inner sleeve blocking entry of the head of a screw into said inner sleeve, said inner sleeve being retractible relative to said outer sleeve against said spring load responsive to axial force against said blocking means of a screw head seeking entry into said inner sleeve, said release means having response to a predetermined extent of said relative retraction of the inner sleeve to effect release of the blocking means from its blocking condition so as to allow entry of the head of a screw into the inner sleeve beyond said blocking means, and the spring load having response to release of the blocking means to return the inner sleeve and blocking means to said advanced position so as to block the head of a screw previously entered into the inner sleeve beyond the blocking means from escaping in the opposite direction out of the inner sleeve.

38. A nosepiece for a screwdriving tool for gripping the screw for engagement by the driving bit of the tool and for guiding the screw during driving action of the bit into the work, including a coupling for detachably supporting the nosepiece to the housing of the tool in axial alignment with the driving bit, an outer sleeve supported by the coupling for relative axial movement, said outer sleeve having an end which faces away from said coupling, an internal annular groove axially spaced from said end, and a portion between said end and groove, an inner sleeve axially slidable within the outer sleeve having a rear shoulder normally abutting upon a rear shoulder of the outer sleeve under the bias of a spring load, ball elements carried in radial holes of the inner sleeve, said ball elements normally being engaged by said portion of said outer sleeve and thereby being secured in a position protruding in a common plane into the interior of the inner sleeve in surrounding relation to the driving bit of the tool and normally blocking axial passage of the head of a screw in the inner sleeve beyond the ball elements in either direction, the inner sleeve being axially movable away from said end relative to the outer sleeve to bring the ball elements into register with the groove, and the groove being of sufficient radial depth to partially receive the registered ball elements so as to unblock the interior of the inner sleeve to allow axial movement of the head of a screw in either direction past the ball elements.

* * * * *